United States Patent [19]

Takeuchi et al.

[11] Patent Number: 4,885,226

[45] Date of Patent: Dec. 5, 1989

[54] ELECTROPHOTOGRAPHIC PHOTOSENSITIVE SENSOR

[75] Inventors: Masaru Takeuchi, Uji; Kazuyuki Gotoh; Kenichiro Wakisaka, both of Hirakata; Kazuhiko Honma, Osaka; Takeo Fukatsu, Uji; Shoichi Nakano, Hirakata; Yukinori Kuwano, Katano, all of Japan

[73] Assignee: Sanyo Electric Co., Ltd., Moriguchi, Japan

[21] Appl. No.: 251,944

[22] Filed: Sep. 29, 1988

Related U.S. Application Data

[63] Continuation of Ser. No. 2,954, Jan. 13, 1987, abandoned.

[30] Foreign Application Priority Data

| | | | |
|---|---|---|---|
| Jan. 18, 1986 | [JP] | Japan | 61-8526 |
| Sep. 5, 1986 | [JP] | Japan | 61-210036 |
| Sep. 20, 1986 | [JP] | Japan | 61-222321 |

[51] Int. Cl.[4] ..... G03G 5/14

[52] U.S. Cl. ..... 430/65; 430/84

[58] Field of Search ..... 430/64, 65, 67, 84, 430/95, 133; 204/192 P; 437/2

[56] References Cited

U.S. PATENT DOCUMENTS

| | | | |
|---|---|---|---|
| 4,265,991 | 5/1981 | Hirai et al. | 430/64 |
| 4,394,426 | 7/1983 | Shimizu et al. | 430/66 |
| 4,492,810 | 1/1985 | Oushinsky et al. | 430/86 |
| 4,534,099 | 8/1985 | Howe | 437/2 |
| 4,568,622 | 2/1986 | Minami et al. | 430/57 |
| 4,705,912 | 11/1987 | Nakashima et al. | 437/2 |

*Primary Examiner*—John L. Goodrow

*Attorney, Agent, or Firm*—W. G. Fasse; D. H. Kane, Jr.

[57] ABSTRACT

An electrophotographic photosensitive sensor comprises a blocking layer, a photoconductive layer and a surface layer made mainly of microcrystalline or amorphous silicon and/or germanium and formed on a conductive substrate. At least one of the layers including the blocking layer, the photoconductive layer or the surface layer includes a multilayer which includes a plurality of constituent thin layers having different optical energy band gaps.

7 Claims, 15 Drawing Sheets

ELECTROPHOTOGRAPHIC PHOTOSENSITIVE SENSOR

This application is a continuation of Application Ser. No.: 002,954, filed Jan. 13, 1987 now abandoned.

BACKGROUND OF THE INVENTION

1. Field of the Invention

This invention relates to an electrophotographic photosensitive sensor and more particularly to a sensor made mainly of non-monocrystalline silicon and/or germanium.

2. Description of the Prior Art

As described in U.S. Pat. No. 4,265,991, an electrophotographic photosensitive sensor made mainly of amorphous silicon, has various advantages as compared to the one made mainly of selenium or cadmium sulfide. For example, it has a higher photoconductivity; it has a sperior heat resisting property and a sperior abrasion resisting property; and it is harmless to its environment. In case of an electrophotographic photosensitive sensor having a photoconductive layer made mainly of amorphous silicon, however, it is desired that the photoconductive layer is made to have a higher dark resistivity and be sufficiently thick for holding electrostatic charges long enough for a developing process.

Recently, much attention has been paid to amorphous or microcrystalline silicon in the technical field concerning a solar cell. Generally, it is expected that this material will improve the sensitivity of electrophotographic photosensitive sensors. Microcrystalline silicon has a small optical energy band gap and a high dark conductivity, e.g., $10^{-3}$–$10^{-4}\Omega^{-1}cm^{-1}$. Therefore, charge carriers generated by irradiation of such an electrophotographic photosensitive sensor having a photoconductive layer made mainly of microcrystalline silicon, can move readily in the photoconductive layer, but it becomes difficult to hold enough surface electrostatic charges.

Although electrophotographic photossensitive sensors are now used not only in an electrophotographic machine but also in a laser printer, an LED printer, an intelligent copier and the like, it is desirable that such a photosensitive device should have an ample sensitivity even with respect to light of a longer wavelength. For example, a laser printer utilizes a laser beam with a wavelength of 780nm emitted by a semiconductor laser of an InGaAsP system. However, although a photoconductive layer of the prior art shows a high sensitivity in the wavelength range of 400–700nm, the sensitivity drastically decreases in the range longer than 750nm. Therefore, if the wavelength of the laser becomes longer due to a temperature change, the sensitivity of the photoconductive layer will be influenced and the copied image will become indistinct or blurred. Generally, an electrophotographic photosensitive sensor is provided with a blocking layer between a conductive substrate and a photoconductive layer. The blocking layer prevents so-called minority carriers in the blocking layer from being injected into the photoconductive layer from the substrate. Such injection of minority carriers causes dark decay of electrostatic charges on the surface of the photoconductive layer. A conventional blocking layer made mainly of amorphous silicon containing hydrogen (a-Si:H) is doped with a dopant of a p-type or an n-type. The doped blocking layer prevents so-called minority carriers in the blocking layer from being injected into the photoconductive layer from the substrate.

When the optical energy band gap in a blocking layer of amorphous silicon is set much larger than 1.7eV, carriers tend to be trapped in localized state levels between the band gaps and thus the residual charge becomes rather large. Therefore, the band gap in a blocking layer is generally set about 1.7eV. However, since a blocking layer having a band gap of 1.7eV does not have enough dark resistivity, it can not contribute much to holding the surface electrostatic charges on the photoconductive layer. Further, adhension between a blocking layer of amorphous silicon and a substrae of an aluminum alloy is not so good. Thus, if the blocking layer is deposited thicker than 10 $\mu$m, it will tend to easily peel off. Still further, when a blocking layer of amorphous silicon receives a laser beam of a longer wavelength, interference is caused between the incident beam and a beam reflected by the substrate, since the blocking layer with the relatively large band gap does not effectively absorb the laser beam.

SUMMARY OF THE INVENTION

In view of the above described prior art, it is an object of the present invention to provide an electrophotographic photosensitive sensor which has a high sensitivity and can hold enough surface electrostatic charges.

It is another object of the present invention to provide an electrophotographic photosensitive sensor which has a high sensitivity even with respect to light of a longer wavelength.

It is a further object of the present invention to provide an electrophotographic photosensitive sensor including a blocking layer which has a high dark resistivity, leaves only a small residual charge, prevents light interference caused by reflection from the substrate and has a good adhesion to the substrate.

According to an aspect of the present invention, an electrophotographic photosensitive sensor comprises a conductive substrate; and a semiconductor layer formed on said substrate and made mainly of non-monocrystalline namely of amorphous or microcrystalline silicon and/or germanium, the semiconductor layer including a photoconductive layer, the photoconductive layer including a multilayer, the multilayer including a plurality of constituent thin layers which have different optical energy band gaps.

According to another aspect, a sensor of the present invention, comprises a conductive substrate; a blocking layer formed on the substrate and made mainly of amorphous or microcrystalline silicon and/or germanium; a photoconductive layer formed on the blocking layer and made mainly of amorphous or microcrystalline silicon and/or germanium; and a surface layer formed on the photoconductive layer and made mainly of amorphous or microcrystalline silicon and/or germanium, the surface layer including a multilayer, the multilayer including a plurality of constituent thin layers which have different optical energy band gaps and comparable dark resistivities.

According to a further aspect of the present invention, an electrophotographic photosensitive sensor comprises a conductive substrate; a blocking layer formed on the substrate and made mainly of amorphous or microcrystalline silicon and/or germanium, the blocking layer including a multilayer, the multilayer including a plurality of constituent thin layers which have different optical energy band gaps; a photoconductive layer formed on the blocking layer and made mainly of amorphous microcrystalline silicon and/or germanium; and a surface layer formed on the photoconductive layer and made mainly of amorphous crystalline silicon and/or germanium.

These objects and other objects, features, aspects and advantages of the present invention will become more apparent from the following detailed description of the present invention when taken in conjunction with the accompanying drawings.

DESCRIPTION OF THE PREFERRED EMBODIMENTS AND THE BEST MODE OF THE INVENTION

Figure 1A:
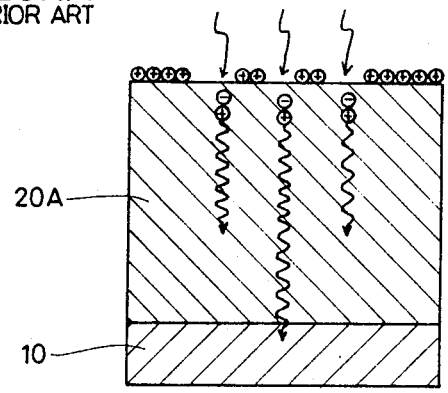
FIG. 1A PRIOR ART
FIGS. 1A and 1B are schematic sectional views of electrophotographic photosensitive sensors according to the prior art.

Referring to FIG. 1A, there is schematically illustrated a sectional view of an electrophotographic photosensitive sensor of the prior art, having a photoconductive layer 20A formed on a conductive substrate 10. The layer 20A is made of a high dark resistivity amorphous silicon having a relatively large optical energy band gap. Before the photoconductive layer 20A is selectively exposed to light, the entire surface thereof is positively charged. When the photoconductive layer 20A is exposed to light, electrons and positive holes are generated in pairs therein. Those generated electrons selectively cancel positive charges on the surface of the photoconductive layer 20A, while the generated positive holes move toward the grounded conductive substrate 10. This electrophotographic photosensitive sensor can hold enough surface charges because of the high dark resistivity of the photoconductive layer 20A, but has a rather low photosensitivity because of the low mobility of positive holes in the photoconductive layer 20A.

Figure 1B:
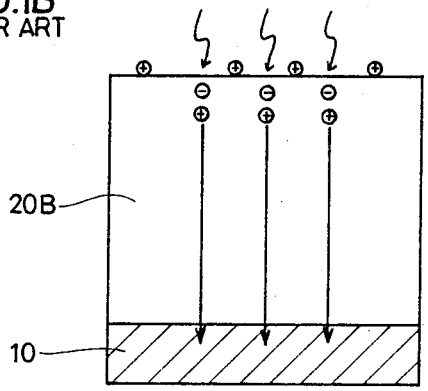
FIG. 1B PRIOR ART

Referring to FIG. 1B, there is shown a sectional view of another electrophotographic photosensitive sensor of the prior art, in which a photoconductive lazer 20B is formed on a conductive substrate 10. The layer 20B is made of silicon having a relatively low energy band gap. This electrophotographic photosensitive sensor has a enough mobility of carriers, but does not hold enough surface charges because of the low dark resistivity of the photoconductive layer 20B.

Figure 2A:
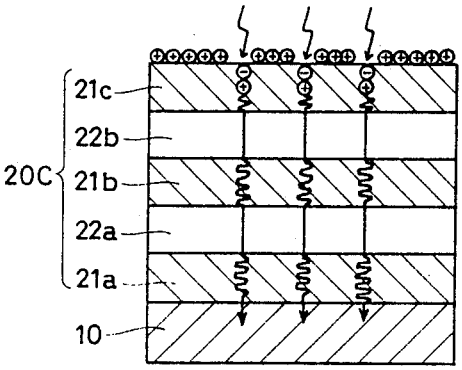
FIG. 2A is a schematic sectional view of an electrophotographic photosensitive sensor according to an embodiment of the present invention.
Figure 2B:
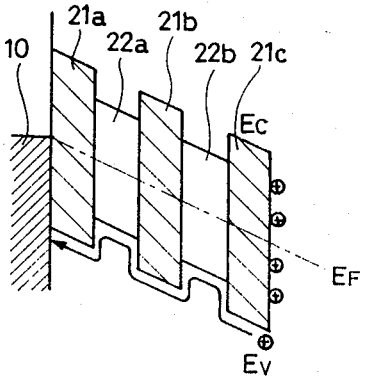
FIG. 2B is an optical energy band profile of the sensor of FIG. 2A.

FIG. 2A is a schematic sectional view of an electrophotographic photosensitive sensor according to an embodiment of the present invention, and FIG. 2B is an optical energy band profile in the sensor of FIG. 2A. Referring to these figures, a photoconductive layer 20C formed as a multilayer is provided on a conductive substrate 10 of Al, Ni, Cu, an Al alloy or the like. In the multilayer 20C, a first group of constituent thin layers **21*a*, 21*b*, 21*c* having relatively large energy band gaps and a second group of constituent thin layers 22*a*, 22*b* having relatively small band gaps are alternately stacked. The band gap is the difference between the lowest level $E_C$ of the conduction band above the Fermi level $E_F$ and the highest level $E_V$ of the valence band below the Fermi level $E_F$. When positive holes generated by irradiation move toward the grounded substrate 10, the movement of the holes is influenced by unevenness of the band gap in the multilayer 20C. As a result, the carrier mobility becomes a little smaller in the photoconductive layer 20C, while the life time of carriers becomes longer. Thus, it becomes possible to improve the duration of the surface charges, with the proper mobility of carriers for maintaining the electrophotographic process. In other words, the first group of constituent layers 21*a*, 21*b*, 21*c* of amorphous silicon are responsible for the longer duration of the surface charges, while the second group of constituent layers 22*a*, 22*b*** of microcrystalline silicon are responsible for the good mobility of carriers.

Although the photoelectric phenomena in the possitively charged photoconductive layers have been described in connection with FIGS. 1A to 2B, the same considerations apply to a negatively charged photoconductive layer.

Amorphous silicon may be adopted as a material having a relatively large energy band gap, and the same may contain a dopant of one conductivity type and/or an element which combines with silicon to form an insulator. An element such as boron in the group III of the periodic table may be used as a dopant of a p-conductivity type, while an element such as phosphorus in the group V may be used as a dopant of an n-conductivity type. Concentration of a dopant which determines the conductivity type may be in the range of $10^{-10}$–$10^{-1}$ at.% and preferably $10^{-7}$–$10^{-1}$ at.%. Oxygen, nitrogen or carbon may be used as an element which combines with silicon to form an insulator. When oxygen is used, concentration thereof may be in the range of $10^{-5}$–61 at.% and preferably $10^{-4}$–60 at.%. When nitrogen is used, concentration thereof may be in the range of $10^{-6}$–60 at.% and preferably $10^{-5}$–57 at.%. When carbon is used, concentration thereof may be in the range of $10^{-4}$–51 at.% and preferably $10^{-3}$–50 at.%. Of course, more than one kind of these elements may be used together.

Microcrystalline silicon may be used as a material having a relatively small energy band gap, and the same may contain a dopant of one conductivity type in the concentration range of $10^{-10}$–$10^{-1}$ at.% and preferably $10^{-7}$–$10^{-1}$ at.%. The microcrystalline silicon may also contain an element which combines with silicon to form an insulator, if necessary. Amorphous silicon, amorphous silicon-germanium and amorphous germanium may also similarly be used as a material having a relatively small energy band gap.

The constituent thin layers 21*a*, 21*b*, 21*c* of a material having relatively large energy band gaps are made to have gaps not smaller than 1.6eV, preferably larger than 1.75eV and more preferably larger than 1.9eV. The constituent thin layers 22*a*, 22*b* having relatively small energy band gaps are made to have gaps smaller than 1.6eV, preferably smaller than 1.5eV and more preferably smaller than 1.4eV. Each of the constituent layers is formed to a thickness in the range of 10Å–200 μm, preferably 10Å–100 μm. However, when each of the constituent layers is formed thinner than about several hundred Å, it is desired to stack the constituent layers until the total thickness of the multilayer becomes more than 1 μm.

Figure 3A:
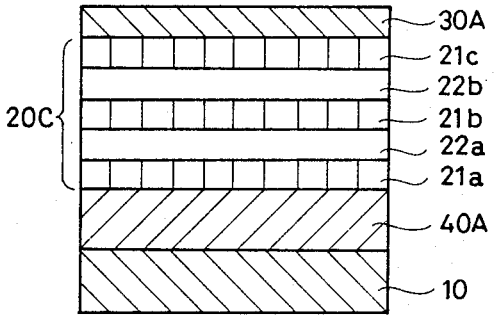
FIGS. 3A to 6B are sectional views of electrophotographic photosensitive sensors according to various other embodiments.

Referring to FIG. 3A, there is shown an electrophotographic photosensitive sensor according to a most typical embodiment of the present invention. In this figure a blocking layer is formed on a conductive substrate 10. The blocking layer 40A is made mainly of amorphous silicon. A photoconductive layer 20C of a multilayer is formed on the blocking layer 40A. The multilayer 20C comprises a first group of constituent thin layers 21*a*, 21*b*, 21*c* having relatively large energy band gaps and a second group of constituent thin layers 22*a*, 22*b* having relatively smaller band gaps. A surface layer 30A made mainly of amorphous silicon is formed on the photoconductive layer 20C. The surface layer 30A having a high resistivity prevents the lateral movement of charges on the surface. The photoconductive layer 20C of the multilayer holds enough surface charges and permits carriers generated by irradiation to efficiently move toward the substrate 10. The blocking layer 40A prevents minority carriers from being injected into the photoconductive layer 20C from the substrate 10.

Figure 3B:
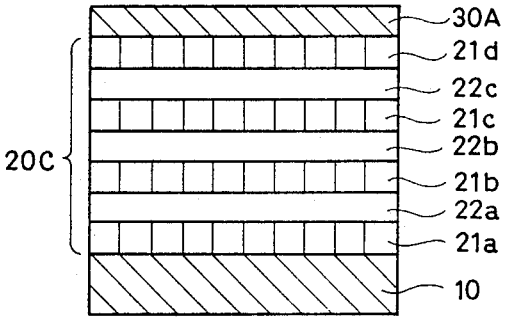

Referring to FIG. 3B, there is shown an electrophotographic photosensitive sensor of a further embodiment, which is similar to that of FIG. 3A, but the blocking layer 40A is omitted. Although the uppermost and lowermost constituent layers of the photoconductive layer 20C in FIGS. 2A, 3A and 3B are the ones having relatively large energy band gaps, this is not a necessary requirement for the present invention.

Figure 4A:
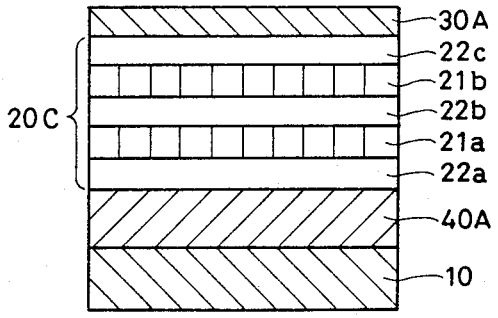
Figure 4B:
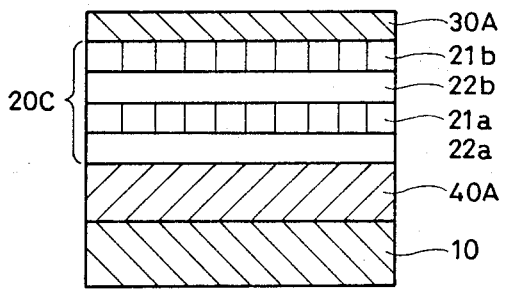

Referring to FIGS. 4A and 4B, there are shown electrophotographic photosensitive sensors of further embodiments. In FIG. 4A, a photoconductive layer 20C of a multilayer includes a lowermost and an uppermost constituent layer 22*a*, 22*c* having relatively small energy band gaps. In FIG. 4B, a multilayer 20C includes a lowermost constituent layer 22*a* having a relatively small energy band gap and an uppermost constituent layer 21*b* having a relatively large band gap.

Figure 5A:
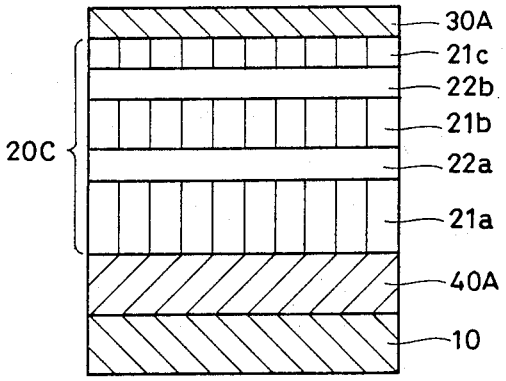
Figure 5B:
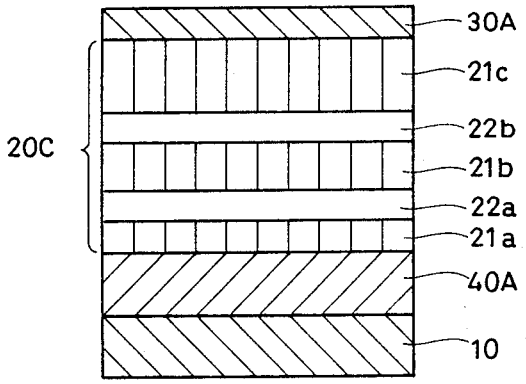

Referring to FIGS. 5A and 5B, there are shown electrophotographic photosensitive sensors of further embodiments. In respect to constituent layers 21*a*, 21*b*, 21*c* having relatively large energy band gaps, the upper layer is made thinner than the lower layer in FIG. 5A and inversely the upper layer is made thicker than the lower layer in FIG. 5B.

Figure 6A:
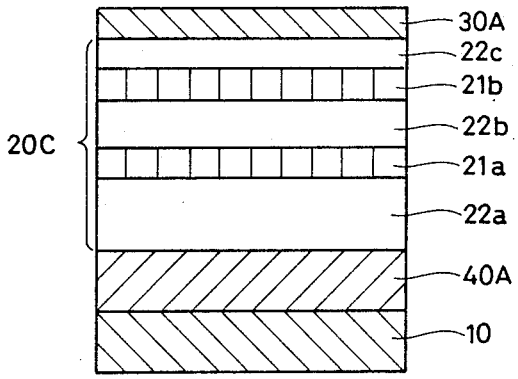
Figure 6B:
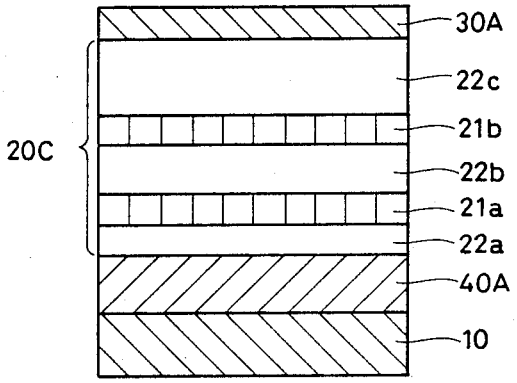

Referring to FIGS. 6A and 6B, there are shown electrophotographic photosensitive sensors of further embodiments. In respect to constituent layers 22*a*, 22*b*, 22*c* having relatively small energy band gaps, the upper layer is made thinner than the lower one in FIG. 6A contrary thereto inversely the upper layer is made thicker than the lower layer in FIG. 6B.

Figure 7A:
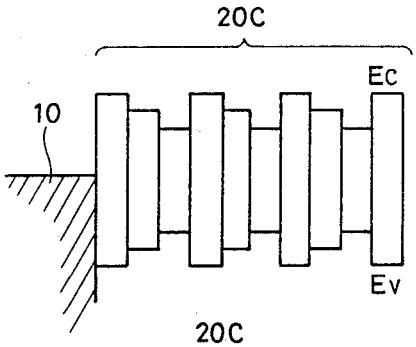
FIGS. 7A to 7C are energy band profiles of electrophotographic photosensitive sensors of further embodiments.
Figure 7B:
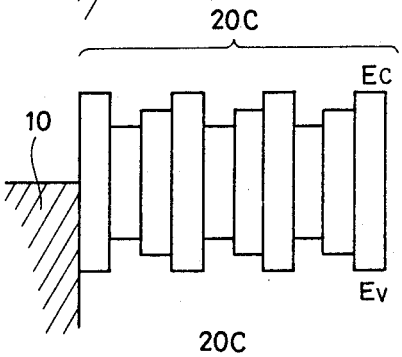
Figure 7C:
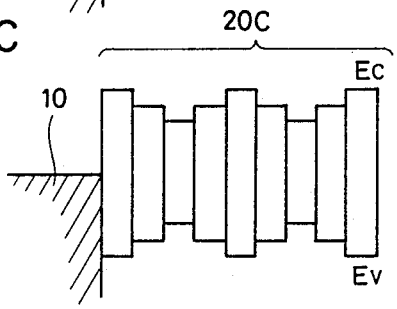

Referring to FIGS. 7A, 7B and 7C, there are shown energy band profiles of photoconductive layers 20C in electrophotographic photosensitive sensors of further embodiments. Each of these photoconductive layers 20C comprises three groups of constituent layers. The energy band gap in any one of the groups is different from that in the other groups. As seen in these figures, the three kinds of constituent layers may be stacked in various manners. Further, it will be understood that the photoconductive layer 20C may comprises more types of constituent layers than those shown. In the multilayer 20C, the energy band gap may be increased or inversely decreased stepwise in the direction of the thickness. Still further, the energy band gap in each of the constituent layers is not necessarily constant in the direction of the thickness.

Figure 8:
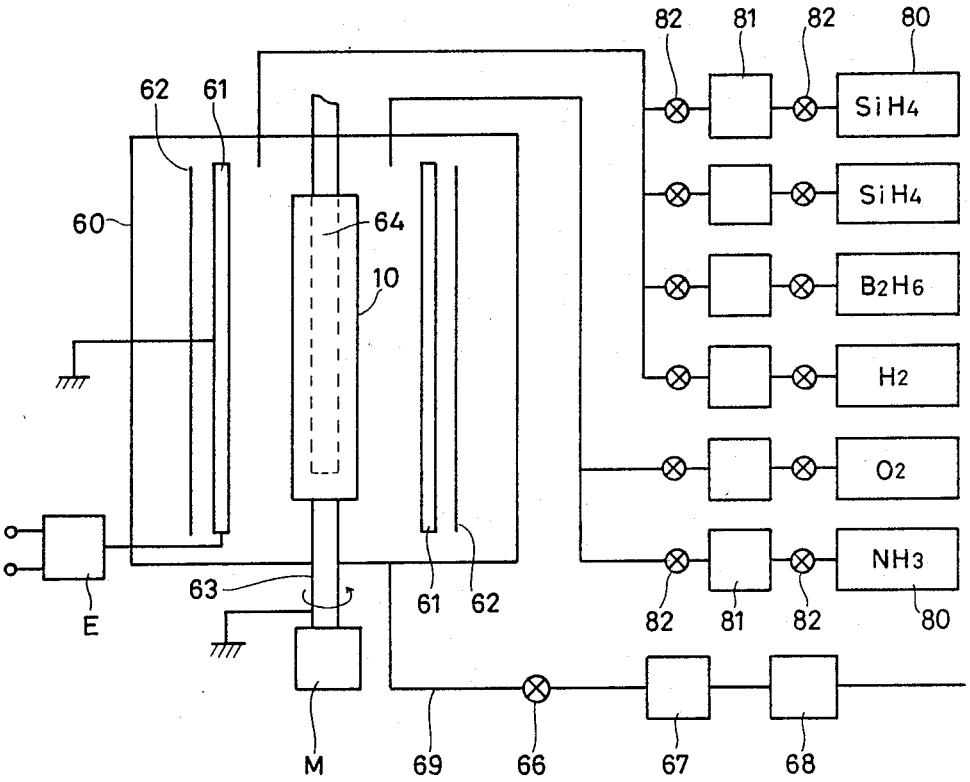
FIG. 8 is a block diagram of a plasma CVD apparatus used in fabricating an electrophotographic sensitive sensor according to the present invention.

Referring to FIG. 8, there is shown a block diagram of a plasma CVD apparatus which may be used in fabricating an electrophotographic photosensitive sensor according to the present invention. A process of fabricating such a member as shown in FIG. 3A will be described in the following.

A discharge electrode 61 having a cylindrical hollow shape extends coaxially inside a plasma shield 62 having a cylindrical hollow shape in a vessel 60. A conductive substrate 10 of a cylindrical hollow shape with a cleaned outer periphery surface is placed coaxially inside the cylindrical electrode 61 and on a rotatable shaft 63. Then, the vessel 60 is evacuated to about $1\times10^{-3}$ Torr by a mechanical booster pump 67 and a rotary pump 68 through a main valve 66 and a duct 69. The substrate 10 is then rotated by a motor M through the shaft 63 and heated to a temperature in the range of about 200°–300° C. by a heater 64 disposed inside the substrate 10. At this time, $SiH_4$ gas, $B_2H_6$ gas and $H_2$ dilution gas are introduced into the vessel 60 from gas sources 80 and maintained at a total pressure in the range of about 1–3 Torr. The ratio of $B_2H_6/(SiH_4+B_2H_6)$ is set in the range of several hundred ppm to several thousand ppm by adjusting mass flow controllers 81 and valves 82, while the dilution ratio of $SiH_4/(SiH_4+H_2)$ is made more than 0.1. A power of about $0.1w/cm^2$ is supplied from a radio frequency power source E of 13.56MHz, with the electrode 61 being connected to the power source E and the substrate 10 being grounded. As a result, plasma is generated between the electrode 61 and the substrate 10 and then the mixed source gas is decomposed for a given time to deposit a blocking layer 40A on the outer surface of the substrate 10.

The vessel 60 is again evacuated to about $10^{-3}$ Torr in order to remove the remaining gas and thereafter, $SiH_4$ gas, $H_2$ gas and $O_2$ gas are introduced as a source gas and maintained at a total pressure in the range of about 1-3 Torr. Some $B_2H_6$ gas may also be introduced as desired. The dilution ratio of $SiH_4/(SiH_4+H_2)$ is more than 0.1. The ratio of $O_2/(SiH_4+O_2)$ is in the range of about 0.001-5%, preferably 0.01-3% and more preferably 0.01-2%. The ratio of $B_2H_6/(SiH_4+B_2H_6)$ may be in the range of 0.01-10000ppm, preferably 0.01-1000ppm, more preferably 0.01-100ppm and most preferably 0.01-10ppm. The radio frequency power to be supplied is of about 0.1w/cm$^2$. Under such conditions, a constituent thin layer 21*a* made mainly of amorphous silicon having a relatively large energy band gap is deposited on the blocking layer 40A to a thickness in the range of 10Å-200 μm, preferably 10Å-100 μm and more preferably 10Å-50 μm. The deposited constituent layer 21*a* has an energy band gap larger than 1.6eV, preferably larger than 1.75eV and more preferably larger than 1.9eV; has an oxygen concentration in the range of $10^{-5}$-61at.% and preferably $10^{-4}$-60at.%; and has a boron concentration in the range of $10^{-10}$-$10^{-1}$ at.% and preferably $10^{-7}$-$10^{-1}$ at.%.

After the vessel 60 is evacuated enough, $SiH_4$ (or $SiF_4$) gas and $H_2$ gas are introduced as a source gas and maintained at a total pressure in the range of about 1-3 Torr. Some $B_2H_6$ gas may also be introduced as desired. The dilution ratio of $SiH_4/(SiH_4+H_2)$ or $SiF_4/(SiF_4+H_2)$ is less than 0.1. The ratio of $B_2H_6/(SiH_4+B_2H_6)$ or $B_2H_6/(SiF_4+B_2H_6)$ is in the range of about 0.01-5000ppm, preferably 0.01-1000ppm and more preferably 0.01-10ppm. The radio frequency power to be supplied is not less than 0.1w/cm$_2$. Under these conditions, a constituent thin layer 22*a* made mainly of microcrystalline silicon having a relatively small energy band gap is deposited on the constituent layer 21*a* to a thickness in the range of 10Å-200 μm, preferably 10Å-100 μm and more preferably 10Å-50 μm. The deposited constituent layer 22*a* has an energy band gap smaller than 1.6eV, preferably smaller than 1.5eV and more preferably smaller than 1.4eV; has an oxygen concentration less than $10^{-4}$ at.%; and has a boron concentration in the range of $10^{-10}$-$10^{-1}$ at.% and preferably $10^{-7}$-$10^{-1}$ at.%.

A first group of constituent thin layers having relatively large energy band gaps and a second group of constituent thin layers having relatively small energy band gaps are deposited and stacked alternately thereby to form a photoconductive layer 20C of a multilayer.

Thereafter, the vessel 60 is evacuated enough, and then $SiH_4$ gas, $NH_3$ gas and $H_2$ dilution gas are introduced as a mixed reaction gas. Some $B_2H_6$ gas may also be introduced as desired. The flow ratio of $NH_3/(SiH_4+NH_3)$ is in the range of 1% o several ten %. The ratio of $SiH_4/(SiH_4+H_2)$ is more than 0.1. The ratio of $B_2H_6/(SiH_4+B_2H_6)$ is in the range of several ppm to several hundred ppm. The radio frequency power to be supplied is of about 0.1w/cm$^2$. Under these conditions, a surface layer 30A is deposited on the photoconductive layer 20C.

Figure 9B:
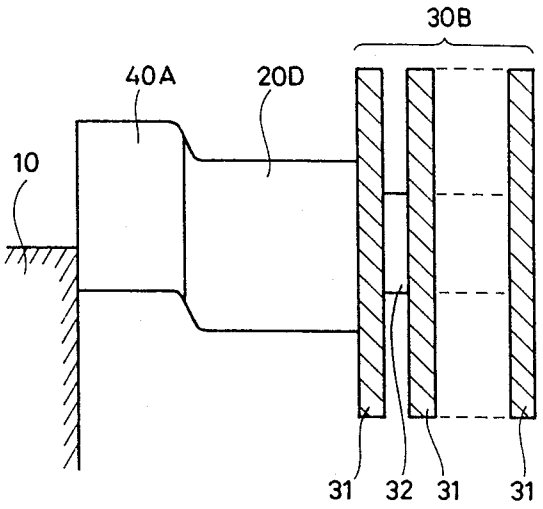
FIG. 9B is an energy band profile in the sensor of FIG. 9A.
Figure 9A:
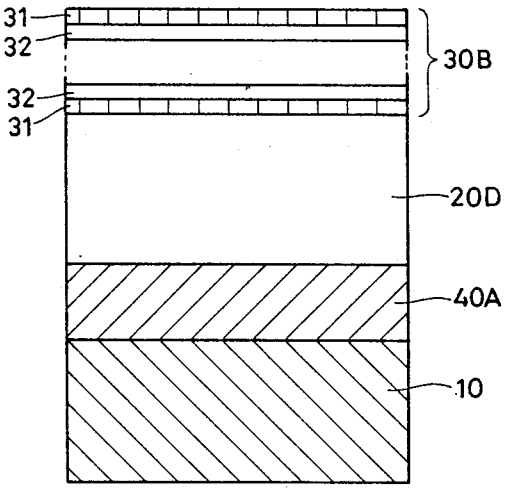
FIG. 9A is a sectional view of an electrophotographic photosensitive sensor of a further embodiment.

Referring to FIG. 9A, there is shown an electrophotographic photosensitive sensor of a still further embodiment. In this figure, a blocking layer 40A, a photoconductive layer 20D and a surface layer 30B of a multilayer are formed in this order on a substrate 10.

The blocking layer 40A is a single layer made mainly of amorphous silicon and formed to a thickness in the range of 0.2-10 μm and preferably 1-5 μm. The blocking layer 40A serves to prevent electrons or positive holes from being injected into the photoconductive layer 20D from the substrate 10, while it permits electrons or positive holes to flow from the photoconductive layer 20D into the substrate 10. In case of blocking the injection of electrons, the blocking layer 40A is doped with a dopant, e.g., B or Al, in the group III of the periodic table. In case of blocking the injection of positive holes, on the other hand, the blocking layer 40A is doped with a dopant, e.g., N, P, Sb or Bi, in the group V.

The photoconductive layer 20D is a single layer made mainly of amorphous silicon and formed to a thickness in the range of 4-40 μm and preferably a thickness of about 20 μm. If desired, the photoconductive layer 20D may be doped with O, N Or C in order to raise the resistivity.

In the surface layer 30B of a multilayer, a first group of constituent thin layers 31 each having a thickness in the range of 10Å-200 μm and a second group of constituent thin layers 32 each having a thickness in the same range are stacked alternately. The outermost and innermost constituent layers of the surface layer 30B belong to the first group. The constituent layers 31 in the first group are made to have energy band gaps larger than 1.5eV. In the first group, the energy band gap may be made larger in an outer constituent layer than in an inner layer. Further, an outer constituent layer in the first group may be made thicker than an inner layer in order to prvent a damage due to corona discharge during copying from reaching a deeper layer. The energy band gap in constituent layers 31 in the first group can be controlled by adding O, C or an element such as N in the group V of the periodic table in the concentration range of $1\times10^{16}$-$1\times10^{21}$ atoms/cc.

The constituent layers 32 in the second group are made to have energy band gaps smaller than 1.3eV, whereby the difference in the energy band gap is made to be more than 0.2eV between the first and second groups of constituent layers. The second group of constituent layers 32 contributes to effectively absorbing light of a longer wavelength.

The first and second groups of constituent layers both may be made of amorphous silicon-germanium (a-$Si_{1-x}Ge_x$). In this case, the first group of constituent layers 31 have compositions preferably in the range of $0<x\leqq0.3$, while the second group of constituent layers 32 have compositions preferably in the range of $0.5\leqq x<1.0$. Alternatively, the first group of constituent layers 31 may be made of a-Si and the second group of constituent layers 32 may be made of a-$Si_{1-x}Ge_x$. In this case, the first group of constituent layers 31 of a-Si preferably contain O, C or an element such as N in the group V of the periodic table in the concentration range of $1\times10^{16}$-$1\times10^{21}$ atoms/cc, and the second group of constituent layers 32 of a-$Si_{1=x}Ge_x$ preferably have compositions in the range of $0.3\leqq x<1.0$.

Referring to FIG. 9B, there is shown an energy band profile corresponding to an electrophotographic photosensitive sensor such as shown in FIG. 9A. As seen in this figure, a first group of constituent layers 31 and a second group of constituent layers 32 in a surface layer 30B are different by more than 0.2eV in the energy band gap. The outermost constituent layer 31 has a relatively large energy band gap and belongs to the first group.

Figure 10A:
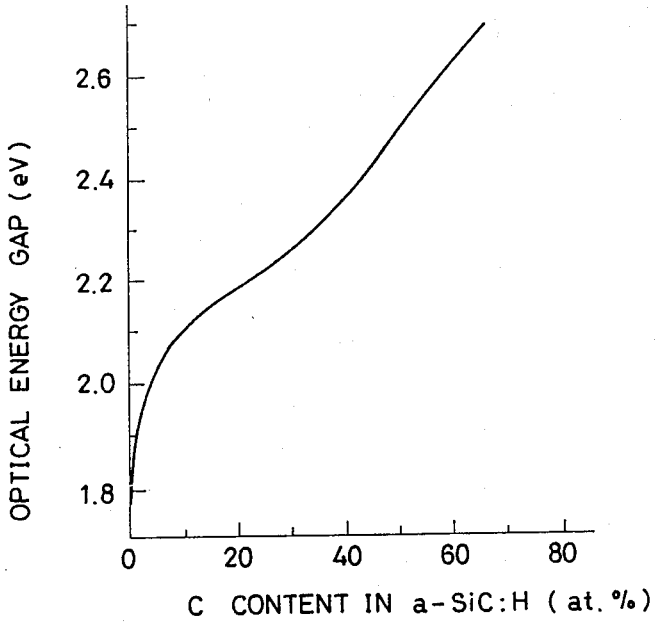
FIGS. 10A to 10B are graphs respectively showing the optical energy gap and the dark conductivity in a-SiC:H with respect to the C content.
Figure 10B:
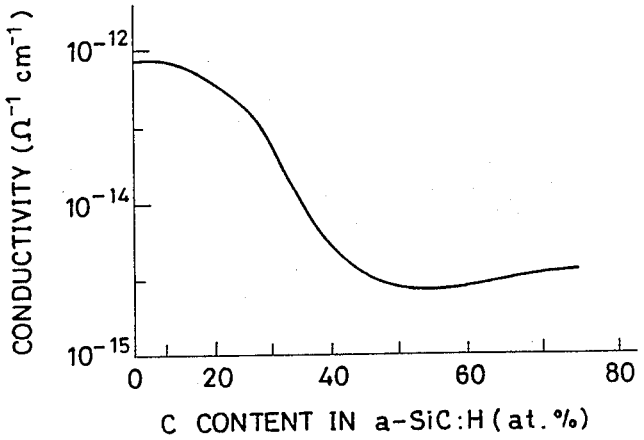
Figure 11A:
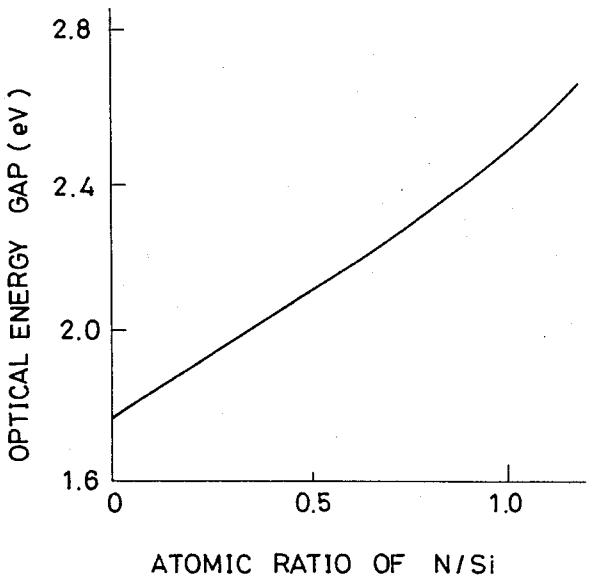
FIGS. 11A and 11B are graphs respectively showing the optical energy gap and the dark conductivity in a-SiN:H with respect to the atomic ratio of N/Si.
Figure 11B:
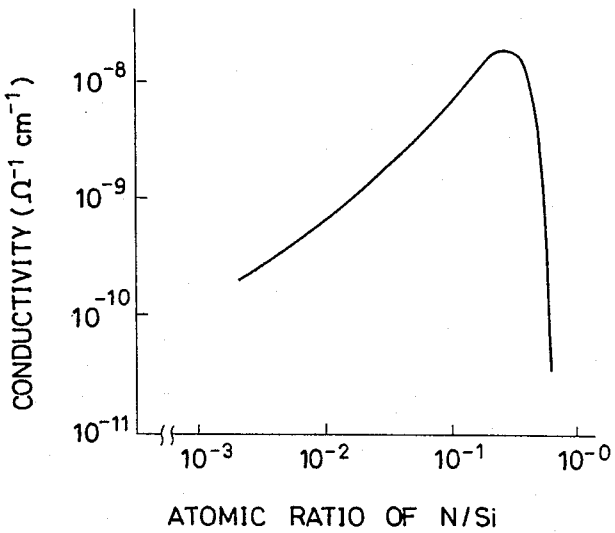

FIGS. 10A and 10B are graphs respectively showing the optical energy band gap and the dark conductivity with respect to the C content (at.%) in a-SiC:H. Similarly, FIGS. 11A and 11B are graphs respectively showing the optical energy band gap and the dark conductivity with respect to the atomic ratio of N/Si in a-SiN:H. In these figures, the dark conductivity does not have a monotonous relation with the energy band gap. Therefore, it becomes possible, by selecting proper compositions of the constituent layers 31, 32, that the layers 31, 32 are different by more than 0.2eV in the energy band gap but have the same or a comparable resistivity.

Figure 12:
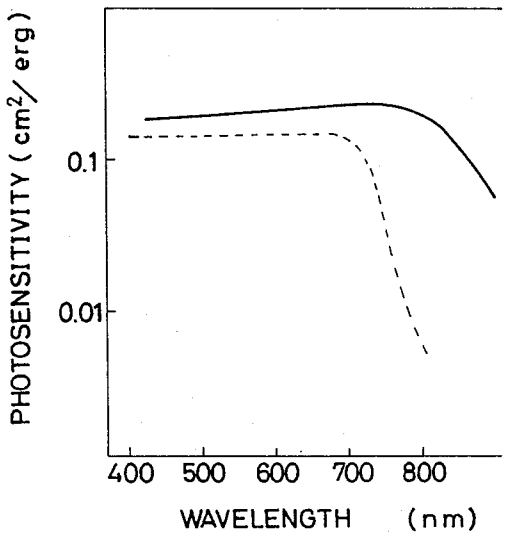
FIG. 12 is a graph showing the photosensitivity of the sensor of FIG. 9A with respect to the wavelength of light.

FIG. 12 is a graph showing the sensitivity of the electrophotographic photosensitive sensor with respect to the light wavelength. The vertical axis indicates the sensitivity ($cm^2$/erg) and the horizontal axis indicates the light wavelength (nm). In this graph, a solid line represents the sesntivity of an electrophotographic photosensitive member such as shown in FIG. 9A, while a broken line represents the sensitivity of an electrophotographic photosensitivie sensor of the prior art. It is seen that the sensor of FIG. 9A has an excellent sensitivity particularly in the wavelength range longer than 750nm.

A process of fabricating the sensor of FIG. 9A will now be described. Firstly, a blocking layer 40A and a photoconductive layer 20D are deposited in this order on a conductive substrate 10 by a plasma CVD method.

Figure 13:
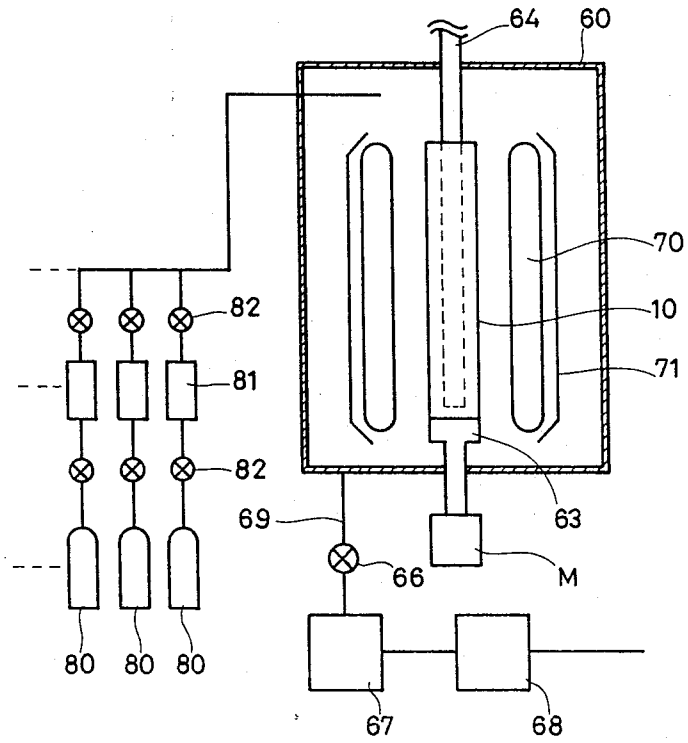
FIG. 13 is a block diagram of a photo CVD apparatus used in fabricating the sensor of FIG. 9A.

Referring to FIG. 13, there is shown a block diagram of a photo CVD apparatus which may be used in depositing a surface layer 30B of a multilayer on the photoconductive layer 20D. This photo CVD appartus is operated similarly as the plasma CVD apparatus of FIG. 8 but is provided with low pressure mercury lamps 70 and reflecting mirrors 71 in place of the discharge electrode 61 and the plasma shield 62. A laser may also be used instead of the mercury lamp. A reaction gas fed from gas sources 80 is decomposed by ultraviolet radiation, and then a first group of constituent layers 31 and a second group of constituent layers 32 are deposited and stacked alternately on the photoconductive layer 20D. In depositing the first group of constituent layers 31, the reaction gas composition is selected such that the constituent layer 31 will consist mainly of Si, Ge and H and contain at least one of O, C and an element such as N in the group V of the periodic table in the concentration range of $1\times1^{16}$–$1\times10^{21}$ atoms/cc. The second group of constituent layers 32 are deposited in a gas atmosphere containing elements of Si, Ge and H. The first and second groups of constituent layers both are deposited under a total gas pressure in the range of about 3–5 Torr.

Although it has been described that the constituent layers in the multilayer 30B may be deposited by a photo CVD method, it will be understood that the constituent layers may also be deposited by a molecular beam epitaxy method or an ion plating method. Monomolecular beams of Si and Ge are used in the molecular beam epitaxy method, while Si and Ge are evaporated in an atmosphere of $H_2$ in the ion plating method.

Figure 14A:
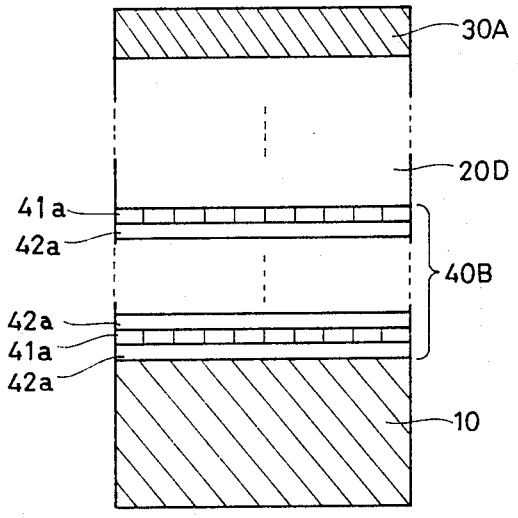
FIG. 14A is a sectional view of an electrophotographic photosensitive sensor of a further embodiment.

Referring to FIG. 14A, there is shown an electrophotographic photosensitive sensor of a still further embodiment, in which a blocking layer 40B of a multilayer, a photoconductive layer 20D and a surface layer 30A are formed in this order on a conductive substrate 10.

In the blocking layer 40B of a multilayer, a first group of constituent layers **41*a* having relatively large energy band gaps and a second group of constituent layers 42*a* having relatively small energy band gaps are alternately stacked. The constituent layers 42*a* of the second group are made mainly of microcrystalline silicon, amorphous silicon doped with Al, amorphous silicon-tin or amorphous silicon-germanium; are doped with B or P in the concentration range of $1\times10^{19}$–$1\times10^{20}$ atoms/cc; and have energy band gaps smaller than 1.7eV. On the other hand, the constituent layers 41*a* of the first group are made of amorphous silicon doped with O, N or C in the concentration range of $1\times10^{20}$–$1\times10^{21}$ atoms/cc and with B or P in the concentration range of $1\times10^{19}$–$1\times10^{20}$ atoms/cc and have energy band gaps larger than 1.7eV. Each of the constituent layers 41*a*, 42*a*** has a thickness in the range of 100–500Å.

The photoconductive layer 20D is made mainly of amorphous silicon doped with O, N or C in the concentration range of $1\times10^{20}$–$1\times10^{21}$ atoms/cc.

The surface layer 30A is made of a-$Si_xN_{1-x}$ (preferably $0.3\leqq\times\leqq1.0$), a-$Si_xC_{1-x}$ (preferably $0.3\leqq\times\leqq1.0$) or a-$Si_xO_{1-x}$ (preferably $0.3\leqq\times\leqq1.0$).

Figure 14B:
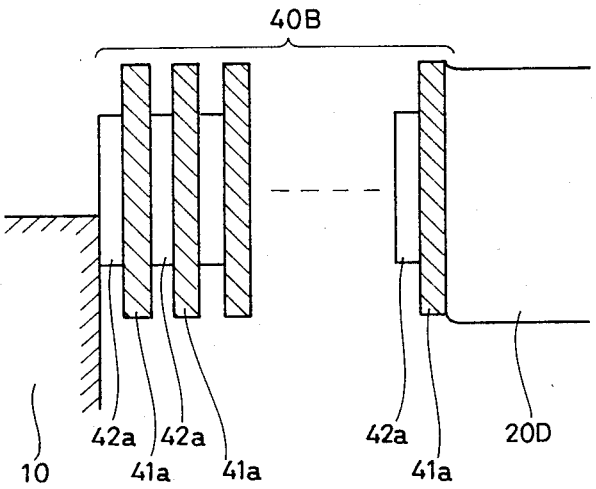
FIG. 14B is an energy band profile in the sensor of FIG. 14A.

Referring to FIG. 14B, there is shown an energy band profile corresponding to the sensor of FIG. 14A. Energy barriers are formed at interfaces between the constituent layers **41*a*, 42*a* in the blocking layer 40B. These barriers impede movement of carriers and raise the dark resistivity of the blocking layer 40B. Since carriers trapped in localized state levels in the large energy band gap of the constituent layer 41*a* can hop into the constituent layer 42*a* having the small band gap, the residual electric charges on the surface layer is reduced. Further, since the constituent layers 42*a* have small optical energy band gaps, they effectively absorb light of a longer wavelength. As a result, the reflection of incident light at the surface of the substrate 10 is reduced and thus interference between the incident light and the reflected light is suppressed. Still further, the adhesion between the blocking layer 40B and the substrate 10 can be improved by adding Al to the constituent layer 42*a* contiguous to the substrate 10**.

Figure 15B:
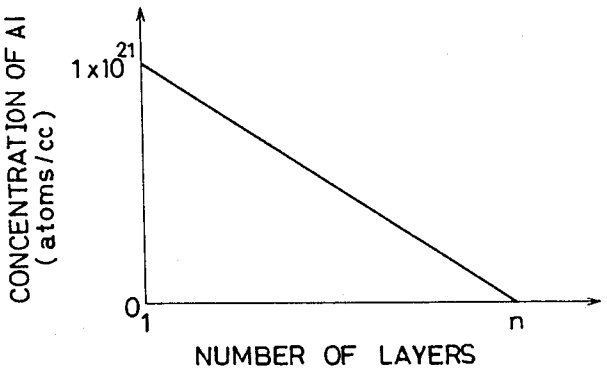
FIGS. 15B and 15C are graphs respectively showing the Al concentration change and the O, N or C concentration change layer by layer in one group of constituent thin layers in a blocking layer of this embodiment.
Figure 15C:
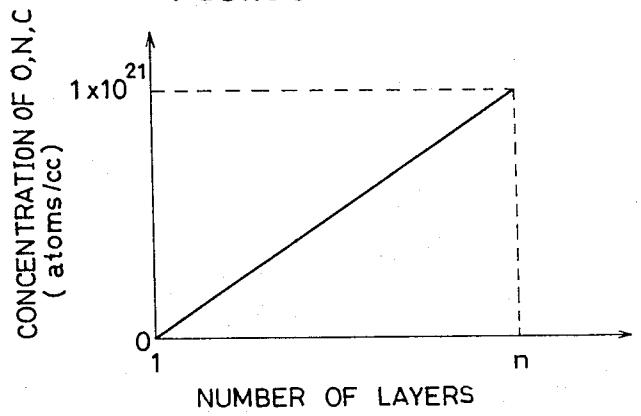
Figure 15A:
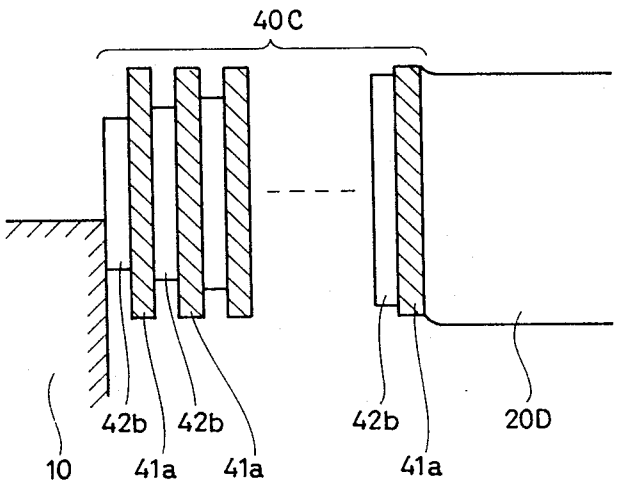
FIG. 15A is an energy band profile in an electrophotographic photosensitive sensor of a further embodiment.

Referring to FIG. 15A, there is shown an energy band profile in an electrophotographic photosensitive sensor of a further embodiment. This energy band profile similar to that of FIG. 14B, except that the energy band gap in constituent layers **42*b* is increased layer by layer from the side of the substrate 10 toward the side of the photoconductive layer 20D**.

FIGS. 15B and 15C are graphs showing the concentration change of impurities in the constituent layers **42*b* in a blocking layer 40C such as represented in FIG. 15A. In each of these graphs, the horizontal axis indicates the number n of the constituent layers 42*b* counted starting from the side of the substrate 10 toward the side of the photoconductive layer 20D, while the vertical axis indicates the impurity concentration (atoms/cc). As seen in FIG. 15B, the Al concentration is highest in the first constituent layer 42*b* (n=1) contiguous to the substrate 10, and it is decreased layer by layer as the number n increases. The decrease comes down to zero in the last constituent layer 42*b* farthest from the substrate 10. As seen in FIG. 15C, on the other hand, the concentration of O, N or C is lowest in the first constituent layer 42*b*** (n=1) and it is increased layer by layer as the number n increases.

Table 1 shows the concentration ranges of the impurities in the constituent layers 42b, 41a in the blocking layer 40C represented in FIG. 15A.

TABLE 1

| | Concentration Ranges of Elements | | |
|---|---|---|---|
| | Element | | |
| Layer | Al (atoms/cc) | O, N, C (atoms/cc) | B (atoms/cc) |
| Constituent Layer 42b | $1 \times 10^{21} \rightarrow 0$ | $0 \rightarrow 1 \times 10^{21}$ | $1 \times 10^{19} \sim 1 \times 10^{20}$ |
| Constituent Layer 41a | 0 | $1 \times 10^{20} \sim 1 \times 10^{21}$ | $1 \times 10^{19} \sim 1 \times 10^{20}$ |

As seen from FIG. 15A, the energy barrier at the interface between the constituent layers 41a and 42b in the blocking layer 40C is lowest on the side of the photoconductive layer 20D and it becomes higher layer by layer toward the side of the substrate 10. Namely, in the blocking layer 40C, a portion nearer to the substrate 10 absorbs light of a longer wavelength more effectively and majority carriers can move more efficiently in that portion.

Figure 16:
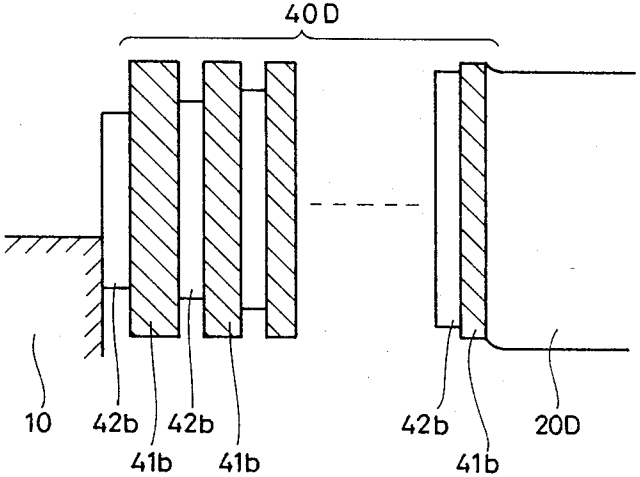
FIG. 16 is an energy band profile in an electrophotographic photosensitive sensor of a further embodiment.

Referring to FIG. 16, there is shown an energy band profile in an electrophotographic photosensitive sensor of a further embodiment. This energy band profile is similar to that of FIG. 15A, except that the thickness of constituent layers 41b is large (e.g., 500Å) on the side of the substrate 10 and decreases layer by layer (e.g., finally to 100Å) toward the side of the photoconductive layer 20D.

When the concentration of Al, Sn or Ge is increased as in the constituent layers 42b represented in FIG. 15A, the dark conductivity of the constituent layers 42b is raised. Thus, the blocking layer 40C might have a less ability to block minority carriers, particularly when the constituent layers 42b are of an amorphous material. In order to supplement the ability of blocking minority carriers, therefore, the thickness of constituent layers 41b may be made larger on the side of the substrate 10 as shown in FIG. 16. With such structure, the ability to hold surface charges becomes sufficient and the dark decay is more suppressed.

Table 2 shows the concentration ranges of the impurities in the constituent layers 42b, 41b and the thickness ranges of these constituent layers in the blocking layer 40D represented in FIG. 16.

TABLE 2

| | Concentration Ranges of Elements and Thickness Ranges of Layers | | | |
|---|---|---|---|---|
| | Element | | | |
| Layer | Al (atoms/cc) | O, N, C (atoms/cc) | B (atoms/cc) | Thickness (Å) |
| Constituent Layer 42b | $1 \times 10^{21} \rightarrow 0$ | $0 \rightarrow 1 \times 10^{21}$ | $1 \times 10^{19} \sim 1 \times 10^{20}$ | 100 |
| Constituent Layer 41b | 0 | $1 \times 10^{20} \sim 1 \times 10^{21}$ | $1 \times 10^{19} \sim 1 \times 10^{20}$ | 500 → 100 |

In this table, the constituent layers 42b, 41b are doped with B up to a concentration in the range of $1 \times 10^{19}$–$1 \times 10^{20}$. However, the B concentration in the constituent layers 41b may be changed layer by layer.

Figure 17A:
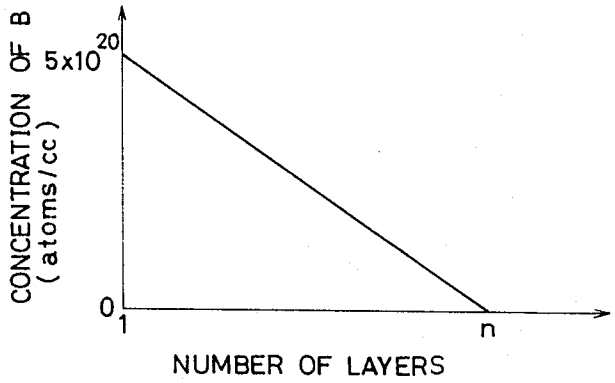
FIGS. 17A and 17B are graphs showing possible two kinds of the B concentration changes layer by layer in one group of constituent thin layers in a blocking layer.
Figure 17B:
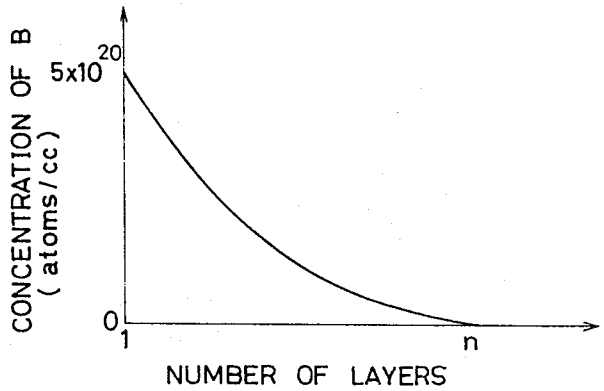

FIGS. 17A and 17B are graphs showing specific examples of the concentration changes of B in the constituent layers 41b in a blocking layer 40D such as represented in FIG. 16. In each of these graphs, the horizontal axis indicates the numbher n of the constituent layer 41b counted from the side of the substrate 10 toward the side of the photoconductive layer 20D, while the vertical axis indicates the B concentration (atoms/cc). The B concentration is highest in the first constituent layer 41b ($n \times 1$) nearest to the substrate 10 and it decreases linearly layer by layer as the number n increases in FIG. 17A, while it is hyperbolically decreased in FIG. 17B. With such a concentration gradient, the ability of blocking minority carriers is improved while the mobility of majority carriers is not decreased.

Figure 18:
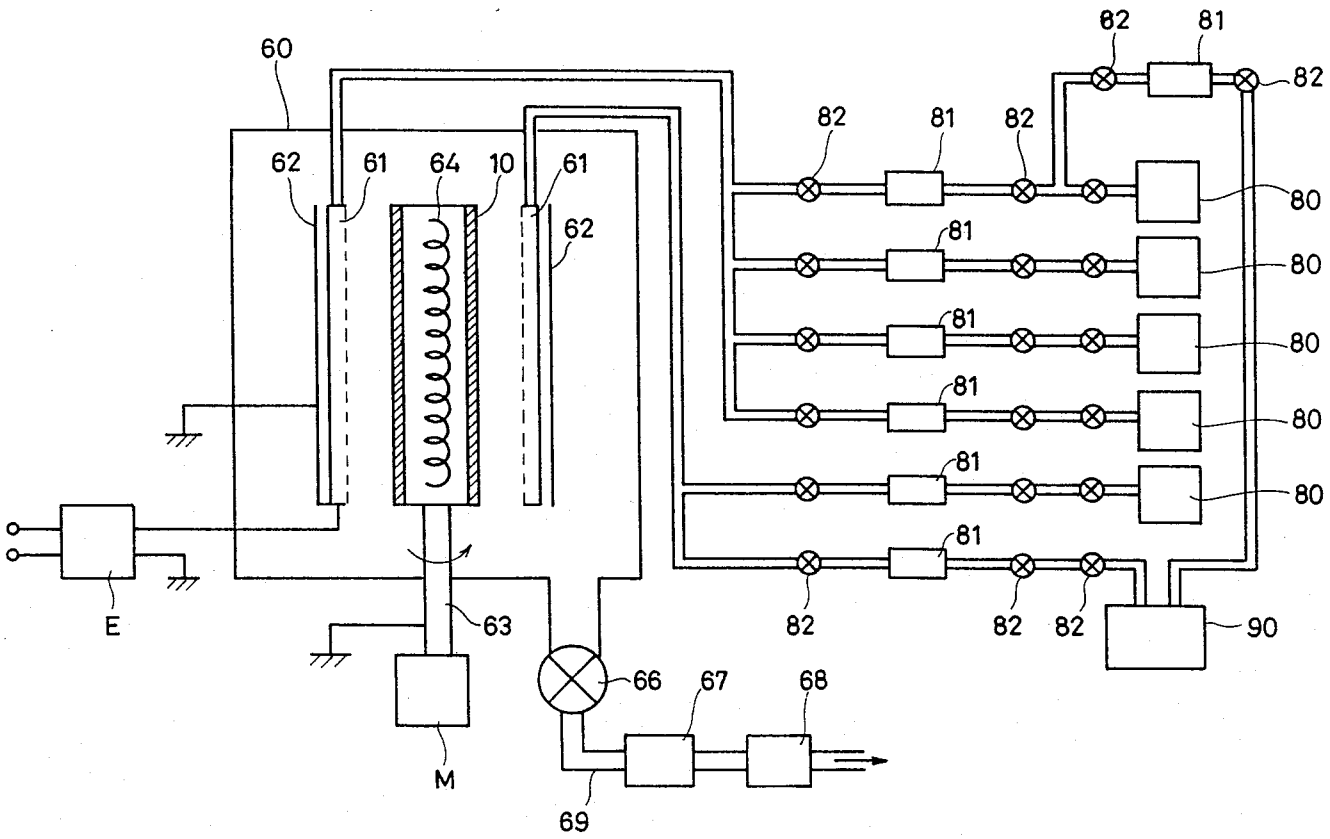
FIG. 18 is a block diagram of a plasma CVD apparatus used in fabricating the sensor of FIG. 14A.

Referring to FIG. 18, there is shown a block diagram of a plasma CVD apparatus which may be used in fabricating an electrophotographic photosensitive sensor such as shown in FIG. 14A. This plasma CVD apparatus is similar to that of FIG. 8 and operated similarly. In fabricating a constituent layer 42a in a blocking layer 40A, gases such as $SiH_4$, $B_2H_6$ and $H_2$ are introduced into a vessel 60 from gas sources 80. At the same time, alkylaluminum such as $Al(CH_3)_3$, $Al(C_2H_5)_3$ or $Al(C_4H_9)_3$ is bubbled in a gas source 90 and also introduced into the vessel 60. Under these conditions, glow discharge is caused between an electrode 61 and a substrate 10, and then a constituent layer 42a containing Al with a preferable concentration is deposited. In fabricating a constituent layer 41a, on the other hand, gases such as $SiH_4$, $B_2H_6$, $H_2$ and $O_2$ are introduced into the vessel 60 from the gas sources 80 and then glow discharge is caused thereby to deposit a constituent layer 41a.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic photosensitive sensor, comprising a conductive substrate; a blocking layer formed on said substrate, said blocking layer including a multilayer comprising a first group of one or more constituent thin layers made of amorphous silicon, said first group of thin layers having relatively large energy band gaps sufficient for effectively blocking minority charge carriers coming from said substrate, and a second group of one or more constituent thin layers made of a material selected from the group consisting of microcrystalline silicon, microcrystalline silicon-germanium alloy, and amorphous silicon-germanium alloy, said second group of thin layers having relatively small energy band gaps of less than 1.7eV for effectively absorbing light of a wavelength longer than 750nm and for reducing reflections of light incident on the surface of said substrate; a photoconductive layer formed on said blocking layer and made mainly of amorphous or microcyrstalline silicon and/or germanium; and a surface layer formed on said photoconductive layer and made mainly of amorphous or microcrystalline silicon and/or germanium.

2. The sensor of claim 1, wherein said constituent thin layers of said second group contain as dopant at least one of boron and phosphorus in the concentration range of $1 \times 10^{19}$–$1 \times 10^{20}$ atoms/cc.

3. The sensor of claim 1, wherein said first group of said constituent thin layers have energy band gaps of at least 1.7eV and contain as dopant at least one of boron and phosphorus in the concentration range of $1 \times 10^{19}$–$1 \times 10^{20}$ atoms/cc and at least one of oxygen, nitrogen and carbon in the concentration range of $1 \times 10^{20}$–$1 \times 10^{21}$ atoms/cc.

4. The sensor of claim 1, wherein said photoconductive layer contains as dopant at least one of oxygen, nitrogen and carbon in the total concentration range of $1\times10^{20}$–$1\times10^{21}$ atoms/cc.

5. The sensor of claim 1, wherein said amorphous silicon of said surface layer is an amorphous silicon derivative of at least one of a-$Si_xO_{1-x'}$ a-$Si_2N_{1-x}$ and a-$Si_xC_{1-x'}$ wherein x is within the range of $0.3\leqq\times\leqq1.0$.

6. The sensor of claim 1, wherein said blocking layer contains a halogen element.

7. The sensor of claim 1, wherein said second group of constituent thin layers comprises a first layer nearer to said substrate and at least one other layer closer to said photoconductive layer, said first layer having a narrower energy band gap than said other layer whereby energy band gaps of said second group of constituent thin layers change from a narrower energy band gap closer to said substrate to a wider energy band gap closer to said photoconductive layer for an effective absorption of light reflected by said substrate.

* * * * *